US005901768A

United States Patent [19]

Herbst

[11] Patent Number: 5,901,768

[45] Date of Patent: May 11, 1999

[54] DOOR, LIGHT, AND METHOD

[76] Inventor: Walter B. Herbst, 1875 N. Pond La., Lake Forest, Ill. 60045

[21] Appl. No.: 08/940,752

[22] Filed: Sep. 30, 1997

Related U.S. Application Data

[63] Continuation of application No. 08/689,727, Aug. 13, 1996, abandoned.

[51] Int. Cl.[6] ..... A47H 1/00

[52] U.S. Cl. ..... 160/90; 49/63

[58] Field of Search ..... 160/90; 49/61, 49/63, 125, 207, 503

[56] References Cited

U.S. PATENT DOCUMENTS

| | | | |
|---|---|---|---|
| 1,207,885 | 12/1916 | Estabrook . | |
| 3,024,837 | 3/1962 | McPhail | 49/61 X |
| 3,086,628 | 4/1963 | Robinson | 160/90 X |
| 3,184,801 | 5/1965 | Fletcher | 49/63 |
| 3,372,522 | 3/1968 | Engstrom | 49/57 X |
| 3,414,039 | 12/1968 | King | 160/90 |
| 4,311,183 | 1/1982 | Herbst et al. . | |

*Primary Examiner*—Blair M. Johnson

*Attorney, Agent, or Firm*—Jack E. Dominik

[57] ABSTRACT

Disclosed is a primary door with window lights in the extreme upper portion. Optionally, the door can use a lowering window or a lowering screen self stored interiorly in a frame defined by the window track and the screen track and a lower stop in the upper half of the door. Thus the door can have a window, or a screen, or indeed can be left wide open for ventilation without diminishing the privacy afforded by the door since entire screen/window assembly is a plane well within the upper half of the door. In addition, replaceable decorative covers, such as muttons, are optionally on the outside and the inside of the door over the window area. The method relates to forming a door frame with a window opening defined by a frame and a cavity in the upper half of the door which contain the elements of vertical tracks for engaging the window and screen in a perpendicular horizontal stop for defining a frame for the window/screen assembly well within the upper half of the door. Optionally the door is formed as an inner and outer half, two halves being press-fittingly or otherwise secured to each other. Thereafter, the window and screen are inserted, and then decorative muttons or other coverings optionally applied.

2 Claims, 4 Drawing Sheets

DOOR, LIGHT, AND METHOD

This is a continuation, of application Ser. No. 08/689,727 filed Aug. 13, 1996 abandoned.

FIELD OF THE INVENTION

The present invention is directed to a primary door useful as a front or rear door in residences, whether single family, town house, villa, or condominium. The door may be molded from two halves which may be plastic, composite, or metal, or more traditional materials (wood, steel) and has provision for a window opening light panel in a frame, which can be covered with an ornamental framing member to give the appearance of multiple window panes or even an arch-like window pane.

SUMMARY OF THE PRIOR ART

Plastic molded doors are known in the art. Primary doors, on the other hand, are one category which must, by building code, have a significant thickness. In many applicaltions whether in hallways, or in a covered porch, it is highly desirable to have a light passthrough at the upper portion of the door. Such windows or "lites" are well known and take on varying shapes. To date, however, being able to remove the window in such a primary door and either screen in the opening or permit direct light and air to pass through is impracticable.

Indeed, the multi-light window panels in the top of the primary door with a mutton frame are quite in fashion today. The glass, on the other hand, may be a single frame, but when framed by muttons has the appearance of multiple panes. Three and nine pane structures are common. The glass may simulate stained glass, it may be translucent, or it may be transparent depending upon the model of the product and the customer's desires. However, the problem still remains with the primary door multi-light panels in that they cannot be opened for ventilation whether with or without screening. A good example of one which has achieved significant commercial success is disclosed in the applicant's U.S. Pat. No. 4,311,183. That patent is addressed to a storm door, having a self-storing window and screen cavity in the lower portion for receiving the window or screen alternatively or simultaneously. However, in the storm door environment, stiffeners and separator tracks are required. The concept of a self-storing primary door or alternatively a door which can be converted from wind blockage to wind passage is highly desirable.

As to primary outer doors, by government regulation they must be at least one and three-quarters inches thick. This is significantly thicker than most storm door constructions. Hence, there is a need to make primary doors differently.

Primary doors abound with multi-light window panels at the top in which a mutton frame surrounds the glass. The glass, of course, may be a single pane, but when framed by the muttons, the glass has the appearance of multiple panes. Both three and nine panes are common. The glass may simulate stained glass, it may be translucent, or it may be transparent depending upon the model of the product and the customer's desires. The problem with the current multi-light panel primary doors is that the window area cannot be opened for ventilation, either with screening or without screening.

SUMMARY OF THE INVENTION

The present invention is directed to a primary door, formed with a window opening and door cavity beneath the window, and which door has a window and optionally a screen which are self-stored interiorly of the door in a frame which surrounds the window opening in the upper half of the door. By mounting the window light near the top of the door, preferably in the upper quarter of the door, privacy is preserved. Thus the door can have a window, or a screen, or indeed be left wide open inasmuch as the screen and the window can be opened or closed or removed from the interior side. That removability in addition to giving numerous options to the door, provides for easy replacement in the event of damage. Moreover, removable mutton frames are optionally employed on the inside. Most desirably, for security purposes, the muttons are permanently secured to the door. The method relates to forming a door frame with a window frame opening and storage cavity beneath the opening, the upper portions of which contain the elements of vertical tracks for engaging the window and the screen. Stops for the window and screen are provided below the window opening. Optionally the door is formed of an inner and outer half, two halves being press-fittingly or otherwise secured to each other, the window and screen inserted, and finally decorative muttons or other coverings optionally applied.

In view of the foregoing, it is a primary object of the present invention to present a primary door with an upper window light in which the window can be opened.

Another object of the present invention is to provide a primary door with a window track in which the frame and its components of the screen and the window are readily accessible from the inside of the door. This object addresses itself not only to ease of assembly at the factory, but to render replacement of the window and screen an easy job for the home owner.

Yet another object of the present invention is to achieve the foregoing objects in the environment of a door which may be molded from SMC (sheet molded composition) which has a very low rate of thermal expansion and contraction to thus accommodate significant swings in temperature in various climates and render the door dimensionally stable. The same door can be formed, however, from other materials including plastic materials, steel or wood. In addition, the same door can be formed in the one-piece configuration, gas blown if desired, and also foam filled for strength and insulating characteristics.

Yet another and most important object of the invention is to achieve all of the objects set forth below in a primary door, the cost and selling price of which will render it highly competitive with doors failing to have the feature of an opening window and a removable window and/or removable screen.

Another advantage of the invention is to cover the window with a decorative frame that will give the appearance of multiple window panes in a variety of shapes, including rectangles and arches.

BRIEF DESCRIPTION OF THE ILLUSTRATIVE DRAWINGS

Further objects and advantages of the present invention will become apparent as the following description of an illustrative embodiment proceeds, taken in conjunction with the accompanying drawings, in which.

Figure 10:
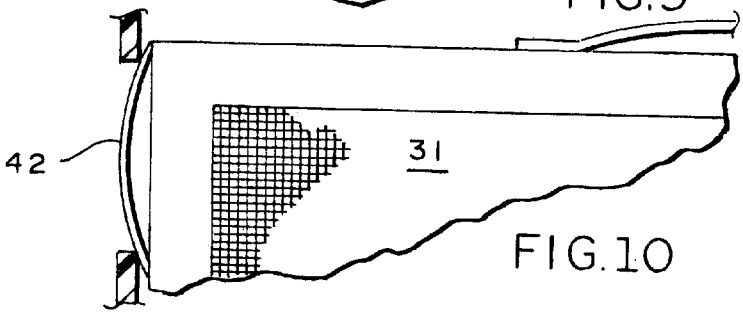
FIG. 10 is a view of the upper corner of the screen illustrating the leaf spring securement arrangement which removably secures the screen in a recess in the screen track.
Figure 11:
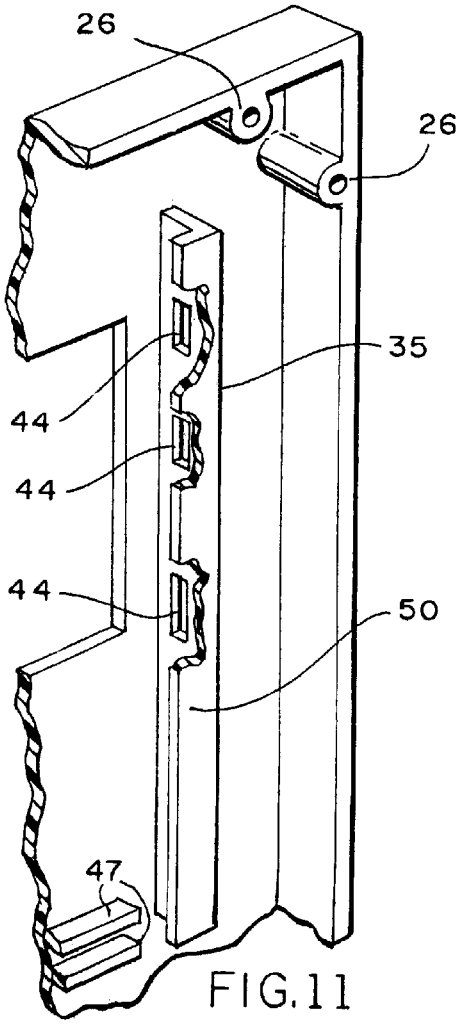
Figure 12:
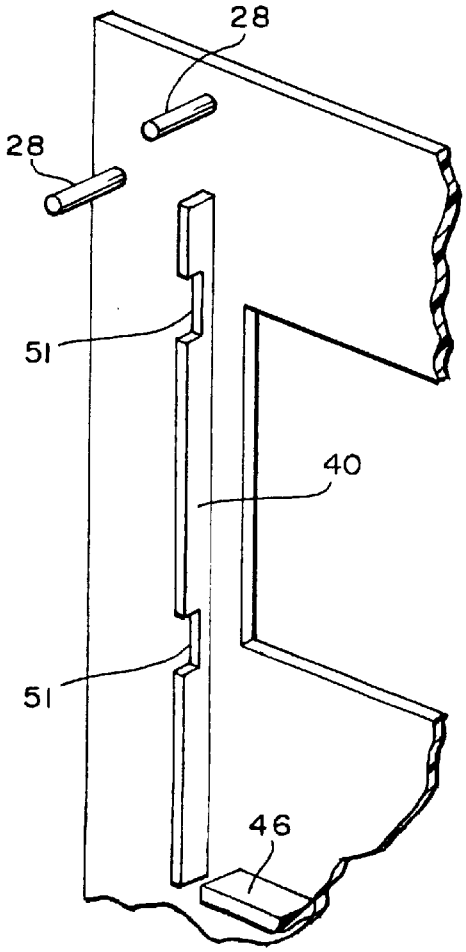

FIG. 11 is an exploded cut-away view of an upper corner of the door illustrating the window track and means for removably securing the two portions of the door to each other and providing a stop at the lower portion for both the screen and the window; and FIG. 12 is a rolled-out broken perspective view of the inner frame illustrating the member forming the screen track and the recesses in that track for removably securing the screen much as shown in FIG. 10.

DESCRIPTION OF A PREFERRED EMBODIMENT

Figure 1:
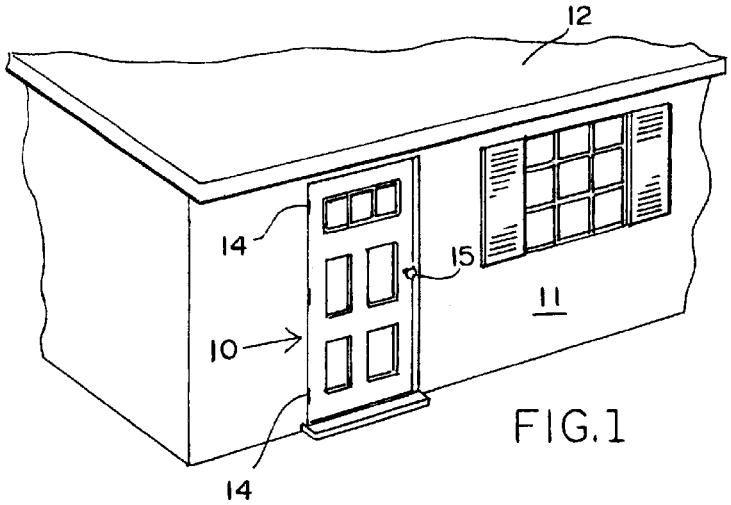
FIG. 1 is a perspective corner view of a typical residential installation showing a door illustrative of the present invention.

The illustrative door 10 is shown in FIG. 1 where it fits in a front wall 11 of a house 12. The door is secured by a plurality of hinges 14 and a knob 15 in place. A light panel assembly 20 is at the upper portion of the door. The light panel assembly is shown with a three-light panel. It will be appreciated that numerous other designs can be employed.

Figures 2, 3:
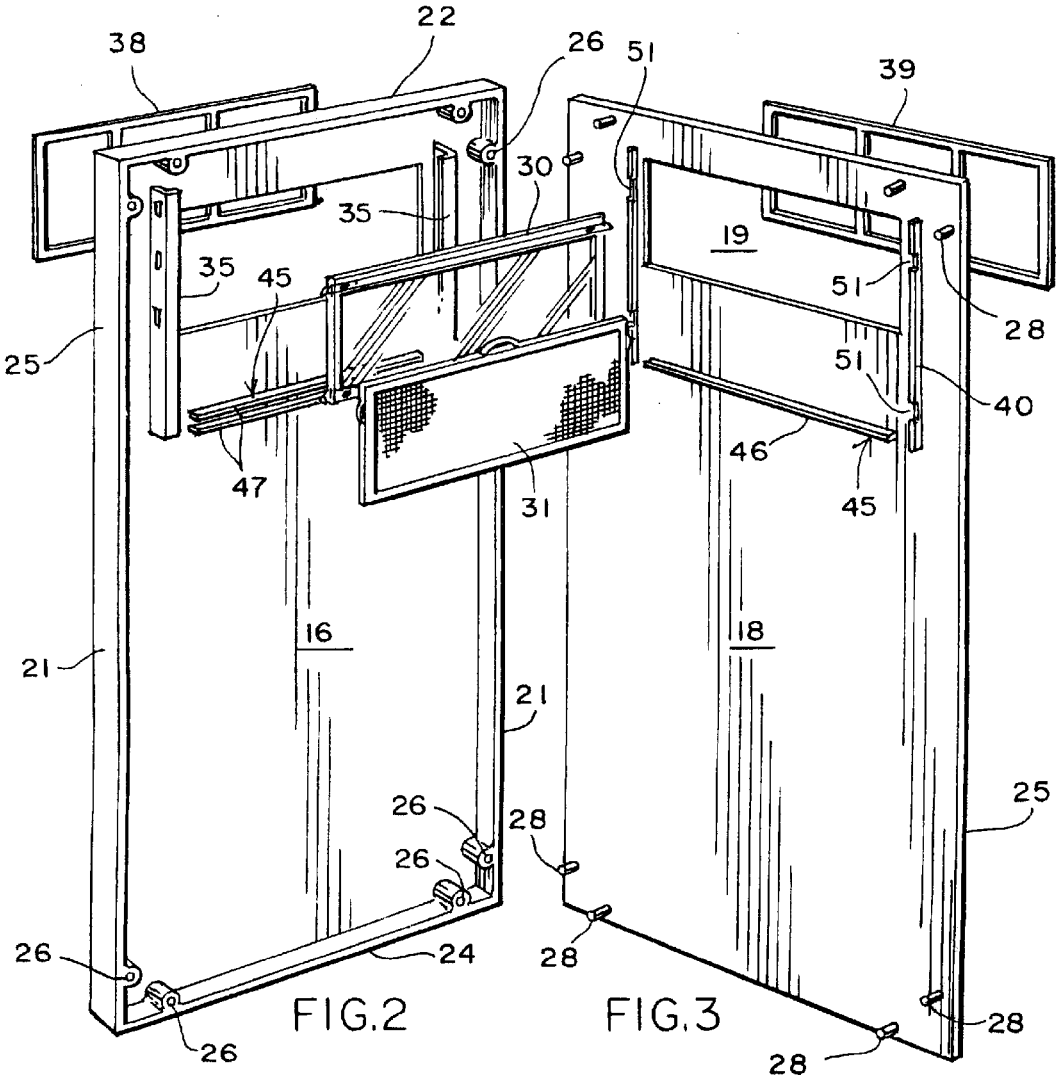
FIG. 2 is a partially exploded perspective view of the outer frame of the door showing the relationship between the outer mutton decor, the glass portion, and the screen.
FIG. 3 is a perspective exploded view of the inner frame portion of the door illustrating the matching members for providing tracks for the window and screen, and optionally disclosing the snap-in mutton decorative frame.

The door 10 has an outer half 16 and an inner half 18 as shown, respectively, in FIGS. 2 and 3. More particularly, in FIGS. 2 and 3 it will be seen that the outer half 16 has lateral edges 21 on opposite sides plus a mating top edge 22 and a bottom edge 24. Adjacent the corners formed by the intersection of the lateral edges 21, the top edge 22, and the bottom edge 24 are snap-acting door assembly members 25 shown here in form of a cup 26 in the outer frame and a plug 28 in the inner frame. The door assembly elements 25 are shown in eight locations, in pairs of two at the four corners of the door.

As will be seen in FIG. 2 the window 30 and screen 31 are of essentially the same size. The window track members 35 flank the window opening 36 in the outer half 16 of the door. The screen track assembly means 40 are provided primarily on the inner half 18 of the door but also in flanking relationship with the inner half window opening 19. When the door halves 16, 18 are joined, a separated double track for window and screen are formed as the window frame 35 and the screen frame 40 abut each other.

Figure 4:
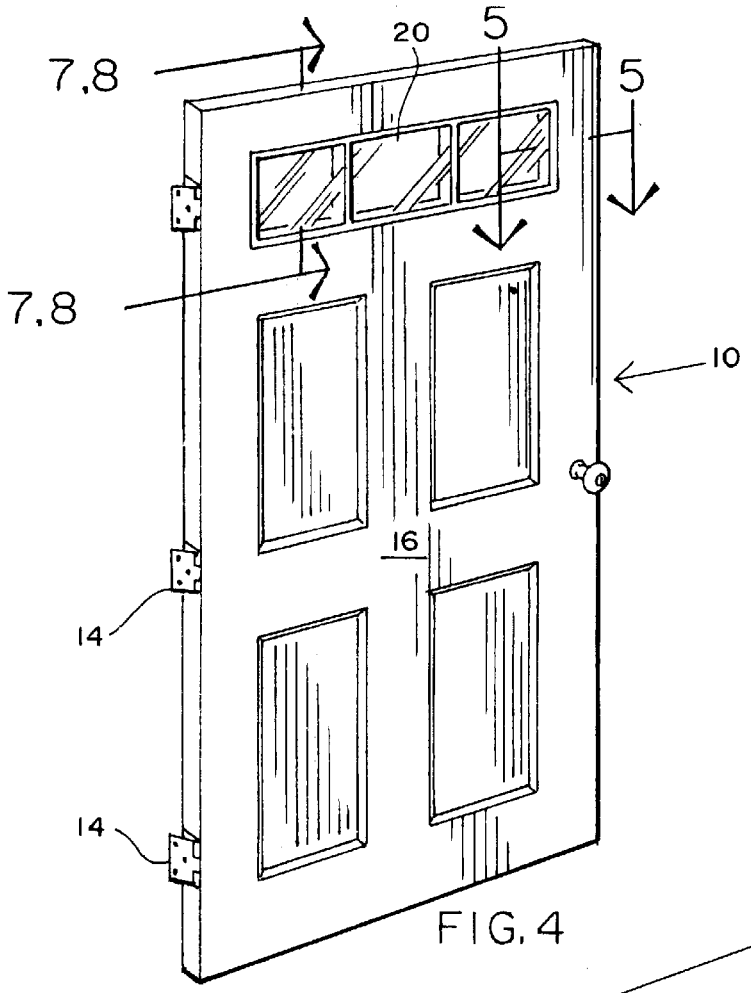
FIG. 4 is an enlarged perspective view of the door showing the light, in three-light form, at its upper portion.

The outer door mutton assembly 38, as shown in FIG. 2, is desirably permanently secured, while the inner mutton assembly frame 39 as shown in FIG. 3 may be removably secured to permit access for changing out the window in the screen. FIG. 4 discloses the door 10 in enlarged form with the light panel in three-light form 20 prominently illustrated at the top.

Figure 5:
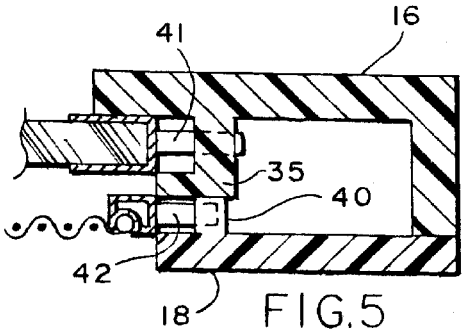
FIG. 5 is an enlarged cut-away view taken essentially along section line 5—5 of FIG. 4 illustrating the relationship between the window, its track, the screen and its track, and the outer and inner frames of the door.
Figure 6:
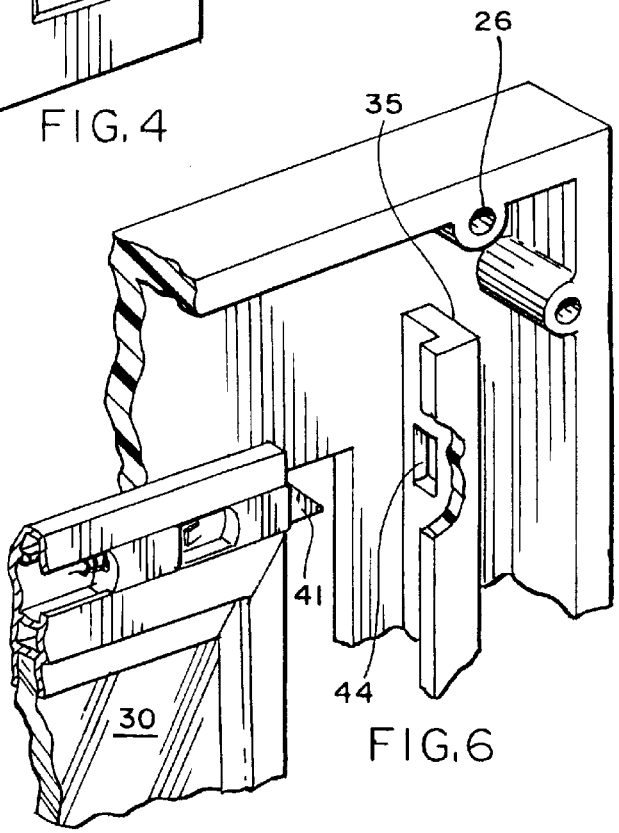
FIG. 6 is a partially broken perspective view illustrating the upper right-hand corner of the window and its removable engagement with the window portion of the track.

FIG. 5 is a sectional view taken essentially along section line 5—5 of FIG. 4 but in enlarged scale. There it will be seen that the outer half 16 and inner half 18 are secured together in such a fashion that the window track 35 coacts with the screen track 40 to trap (when needed) the window lock tab 41 and the screen lock tab 42. As shown in FIG. 6, the window lock tab 41 engages a window lock tab recess 44 provided in the window track 35. When secured in this position, the window rests on the window lock 41 interiorly of the recess 44. Similarly, the screen has a leaf spring-like lock 42 which fits into a complimentary recess 51 for mounting the spring as shown in phantom lines in FIG. 5, similarly to the window lock recess 44 shown in phantom lines in FIG. 5 and shown prominently in FIG. 6.

As a means for preventing the window and screen from dropping inadvertently into the pocket in the lower portion of the door, a stop assembly 45 optionally shown is desirably a stop 46 that protrudes from the inside wall and fits between rails 47 on the outer wall. These are spaced so that when the window or screen are in their lower positions, they will abut or be immediately above the stop assembly 45. The stop assembly 45, particularly when it rests between the rails 47 on the inside of the outer half 16. Outer half 18, together with the other door assembly members 25, reduce the tendency of the door to oil can or otherwise distort immediately below the light panel portion 20.

Figure 7:
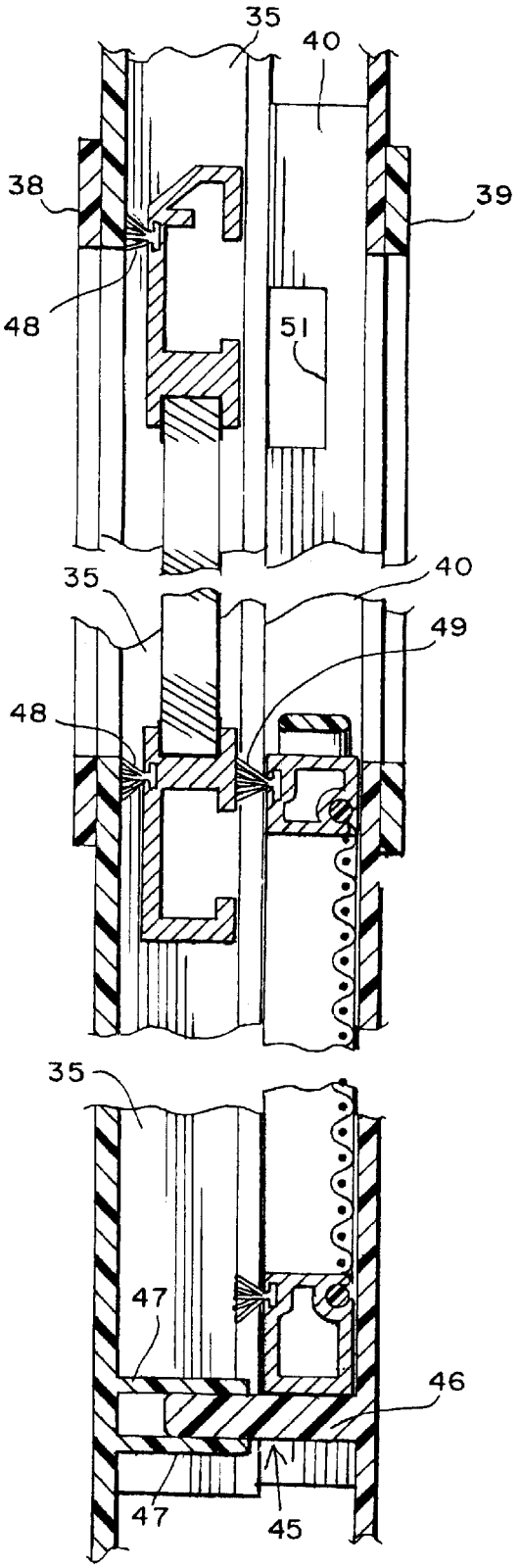
FIG. 7 is an enlarged view taken essentially on section line 7—7 of FIG. 4 and showing the window in the upper or fully closed configuration.
Figure 8:
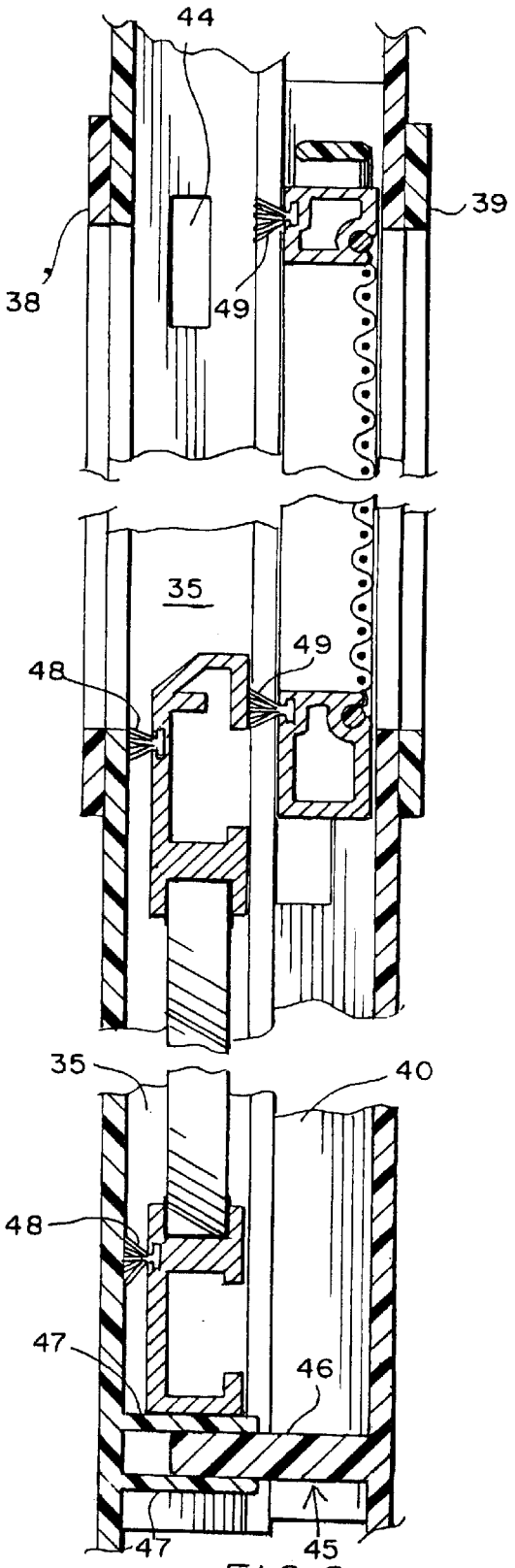
FIG. 8 is taken along section line 8—8 and in the same scale as FIG. 7 but illustrating the screen in the upper or operative position, and the window retracted.

Turning now to FIG. 7 it will be seen that the window 30 shown in broken form is in its upper and locked position. Fur insulation stripping 48 is provided on the exterior portion framing the window to engage the interior portion of the outer frame or half 16. The screen has a bug wipe fur assembly 49 similarly in its inner portion, and further proportioned to engage the window in its lowered configuration, and the lateral portion of the opening in its upper configuration as illustrated in FIG. 8. Alternatively, the stop assembly 45 engages the window 30 at its lower portion when the window is retracted as shown in FIG. 8.

Because there is a zero width tolerance between the screen supporting member and the window supporting members and the tracks the window is first inserted, and then the screen inserted, and they oppose each other secured in their respective tracks. Following that, the inner decorative mutton frame 39 (if used) is installed.

Figure 9:
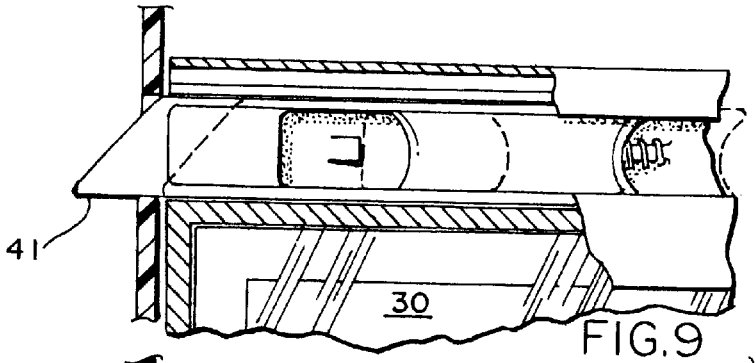
FIG. 9 is an enlarged partially broken view of the upper left-hand corner of the window illustrating how the window lock engages a recess in the track, not unlike that shown in FIG. 6.

Further details of the assembly for locking the screen and the window are illustrated respectively in FIGS. 9 and 10. In FIG. 9 or 11 it will be seen that the window track 35 is provided with recess 44 which is engaged by the window lock 41. Desirably the window lock 41 is as shown spring-loaded into its locking position in the recess 44. As shown in FIG. 10, the screen lock 42 is in the form of a modified leaf spring, and it engages the spring recess 51.

Turning to FIG. 11, it will be seen that the window track 35 is essentially an L-shaped member with the portion adjoining the outer frame serving to contain the recess 44 and a divider face 50 which, as shown in FIG. 5 serves to guide the window in its track, comparably to the screen track 40 as shown in FIG. 12.

The method of the present invention contemplates providing a door with an open portion at the top for a window which can be opened or closed and is self-storing in the door. A collateral aspect of the window panel is providing an interior screen. The two fit in place through a relatively zero clearance opening, and are held in place by the window track and screen track and the corresponding locking engaging elements of the window and the screen. Means are interfittingly secured at the lower portion of the opening to not only provide for stops preventing the window or screen from inadvertently dropping into the interior cavity of the door, but also reinforcing the unsupported span at that point to further render the door resistant to torsional distortion.

It will be understood that various changes in the details, materials and arrangements of parts which have been herein described and illustrated in order to explain the nature of the invention, may be made by those skilled in the art within the principle and scope of the invention as expressed in the appended claims.

What is claimed is:

1. A door with an opening at an upper portion, said opening being associated with door interior cavity means for mounting a window and a screen in a closed or open position in the door, further comprising, in combination, said door having an outer element and an inner element, each of which is proportioned to mate with the other to define a door cavity interiorly of the outer element and inner element, an opening in an upper half of the door in both the outer element and the inner element in juxtaposed relationship each to the other, parallel opposed track members formed integrally in the upper half of the door on both said inner and outer elements in flanking relationship to the opening, thereby defining a pair of tracks, a window and screen each proportioned to penetrate the opening in the door having track engaging means at lateral portions thereof, stop members formed integrally with their respective inner and outer elements and extending perpendicularly to the track members and located below the opening of the door defining, with the tracks, a window and screen frame, securing means on respective ones of said tracks for securing the windows or screens in the closed configuration or stored configuration, said door outer element and its opening, track members, stop members, and securing means being formed as a one-piece molded structure, and said door inner element and its opening, track members, stop members, and securing means being formed as a one-piece molded structure, whereby the window may be used to block the air passing through the door or the window may be dropped and ventilation achieved through the window opening with or without the screen.

2. In the door of claim 1 above, removable decorative muttons effectively positionable on the exterior or interior, or both exterior and interior, of the door overlying the opening area.

* * * * *